US008101066B2

(12) United States Patent
Siskin et al.

(10) Patent No.: US 8,101,066 B2
(45) Date of Patent: Jan. 24, 2012

(54) FLUIDIZED COKING PROCESS

(75) Inventors: Michael Siskin, Randolph, NJ (US); Simon R. Kelemen, Annandale, NJ (US); Christopher P. Eppig, Vienna, VA (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 478 days.

(21) Appl. No.: 11/987,058

(22) Filed: Nov. 27, 2007

(65) Prior Publication Data

US 2008/0135456 A1 Jun. 12, 2008

Related U.S. Application Data

(60) Provisional application No. 60/872,172, filed on Dec. 1, 2006.

(51) Int. Cl.
*C10G 9/32* (2006.01)

(52) U.S. Cl. ..... 208/126; 208/125; 208/127; 208/160

(58) Field of Classification Search ..... 208/126, 208/127, 160, 125
See application file for complete search history.

(56) References Cited

U.S. PATENT DOCUMENTS

| | | | | |
|---|---|---|---|---|
| 3,803,023 | A * | 4/1974 | Hamner | 208/126 |
| 5,284,574 | A | 2/1994 | Chen et al. | |
| 5,472,596 | A | 12/1995 | Kerby et al. | |
| 5,597,474 | A * | 1/1997 | Kerby et al. | 208/50 |
| 2002/0179493 | A1 | 12/2002 | Etter | |
| 2004/0262198 | A1 * | 12/2004 | Siskin et al. | 208/131 |

OTHER PUBLICATIONS

PCT International Search Report, (Apr. 3, 2008).

* cited by examiner

*Primary Examiner* — Walter D Griffin
*Assistant Examiner* — Renee E Robinson
(74) *Attorney, Agent, or Firm* — Malcolm D. Keen; Glenn T. Barrett

(57) ABSTRACT

An improved fluidized coking process wherein an effective amount of a basic material, preferably an alkali or alkaline-earth metal-containing compound, is added to the coking zone to mitigate agglomeration of the coke during the coking of a heavy hydrocarbonaceous feedstock to produce lower boiling products.

10 Claims, 3 Drawing Sheets

FLUIDIZED COKING PROCESS

CROSS REFERENCE TO RELATED APPLICATIONS

This application claims benefit to the filing date of U.S. provisional application No. 60/872,172 filed Dec. 1, 2006.

FIELD OF THE INVENTION

This invention relates to an improved fluidized coking process wherein an effective amount of a basic material, preferably an alkali or alkaline-earth metal-containing compound, is added to the coking zone to mitigate agglomeration of the coke during the coking of a heavy hydrocarbonaceous feedstock to produce lower boiling products.

BACKGROUND OF THE INVENTION

Fluidized coking is a well established petroleum refinery process in which a heavy petroleum feedstock, typically a non-distillable residue (resid) from atmospheric and/or vacuum fractionation, are converted to lighter, more valuable materials by thermal decomposition (coking) at temperatures from about 900° F. (482° C.) to about 1100° F. (593° C.). Conventional fluid coking is performed in a process unit comprised of a coking reactor and a heater or burner. A petroleum feedstock is injected into the reactor in a coking zone comprised of a fluidized bed of hot, fine, coke particles and is distributed relatively uniformly over the surfaces of the coke particles where it is cracked to vapors and coke. The vapors pass through a gas/solids separation apparatus, such as a cyclone, which removes most of the entrained coke particles. The vapor is then discharged into a scrubbing zone where the remaining coke particles are removed and the products cooled to condense the heavy liquids. The resulting slurry, which usually contains from about 1 to about 3 wt. % coke particles, is recycled to extinction to the coking zone. The balance of the vapors go to a fractionators for separation of the gases and the liquids into different boiling fractions.

Some of the coke particles in the coking zone flow downwardly to a stripping zone at the base of the reactor vessel where steam removes interstitial product vapors from, or between, the coke particles, and some adsorbed liquids from the coke particles. The coke particles then flow down a standpipe and into a riser that moves them to a burning, or heating zone, where sufficient air is injected to burn at least a portion of the coke and heating the remainder sufficiently to satisfy the heat requirements of the coking zone where the unburned hot coke is recycled. Net coke, above that consumed in the burner, is withdrawn as product coke.

Another type of fluid coking employs three vessels: a coking reactor, a heater, and a gasifier. Coke particles having carbonaceous material deposited thereon in the coking zone are passed to the heater where a portion of the volatile matter is removed. The coke is then passed to the gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater. Coke is also recycled from the heater to the coking reactor to supply the heat requirements of the reactor.

The rate of introduction of resid feedstock to a fluid coker is limited by the rate at which it can be converted to coke. The major reactions that produce coke involve cracking of aliphatic side chains from aromatic cores, demethylation of aromatic cores and aromatization. The rate of cracking of aliphatic side chains is relatively fast and results in the buildup of a sticky layer of methylated aromatic cores. This layer is relatively sticky at reaction temperature. The rate of de-methylation of the aromatic cores is relatively slow and limits the operation of the fluid coker. At the point of fluid bed bogging, the rate of sticky layer going to coke equals the rate of introduction of coke precursors from the resid feed. An acceleration of the reactions involved in converting the sticky material to dry coke would allow increased reactor throughput at a given temperature or coking at a lower temperature at constant throughput. Less gas and higher quality liquids are produced at lower coking temperatures. Sticky coke particles can agglomerate (become heavier) and be carried under into the stripper section and cause fouling. When carried under, much of the sticky coke is sent to the burner, where this incompletely demethylated coke evolves methylated and unsubstituted aromatics via thermal cracking reactions that ultimately cause foaming problems in the acid gas clean-up units.

Therefore, there remains a need in the art for improved fluid coking processes that are capable of overcoming the problems associated with the formation of sticky material.

SUMMARY OF THE INVENTION

In accordance with the present invention there is provided a process for converting a heavy hydrocarbonaceous feedstock to lower boiling products, which process is performed in a fluid coking process unit comprised of a fluid coking reactor and a heater, said fluid coking reactor containing a coking zone, a scrubbing zone located above said coking zone for collecting vapor phase products, and a stripping zone, located below the coking zone, for stripping hydrocarbons from solid particles passing downwardly through the stripping zone, which process comprises:

(a) introducing the heavy hydrocarbonaceous feedstock having a Conradson carbon content of at least about 5 wt.% and an effective amount of a basic material containing an alkali metal, an alkaline-earth metal or combinations thereof, into said coking zone containing a fluidized bed of solid particles and maintained at effective coking temperatures and pressures, wherein there is produced a vapor phase product, including normally liquid hydrocarbons, and where coke is deposited on said solid particles;

(b) passing said vapor phase product to said scrubbing zone;

(c) passing said solid particles from said coking zone, with coke deposited thereon, downwardly through said coking zone, past said stripping zone, thereby stripping hydrocarbons from the solid particles with a stripping agent, wherein the stripped solid particles exit said fluid coking reactor and are passed into said heating zone which contains a fluidized bed of solid particles and which is operated at a temperature greater than that of the coking zone; and (d) recycling at least a portion of the solid particles from the heating zone to the coking zone.

In a preferred embodiment the feedstock is selected from the group consisting of heavy and reduced petroleum crudes, petroleum atmospheric distillation bottoms, petroleum vacuum distillation bottoms, pitch, asphalt, tar sands, bitumen, and liquid products derived from a coal liquefaction process or an oil shale conversion process.

In another preferred embodiment of the present invention the basic material is one containing at least one alkali metal selected from Na and K.

In yet another preferred embodiment, the basic material is one containing at least one alkaline-earth metal selected from Ca and Mg.

In still other preferred embodiments the basic material is an alkali or alkaline-earth compound selected from oxides, hydroxides, carbonates, acetates, cresylates and alkyl and aryl carboxylates.

DETAILED DESCRIPTION OF THE INVENTION

Figure 1:
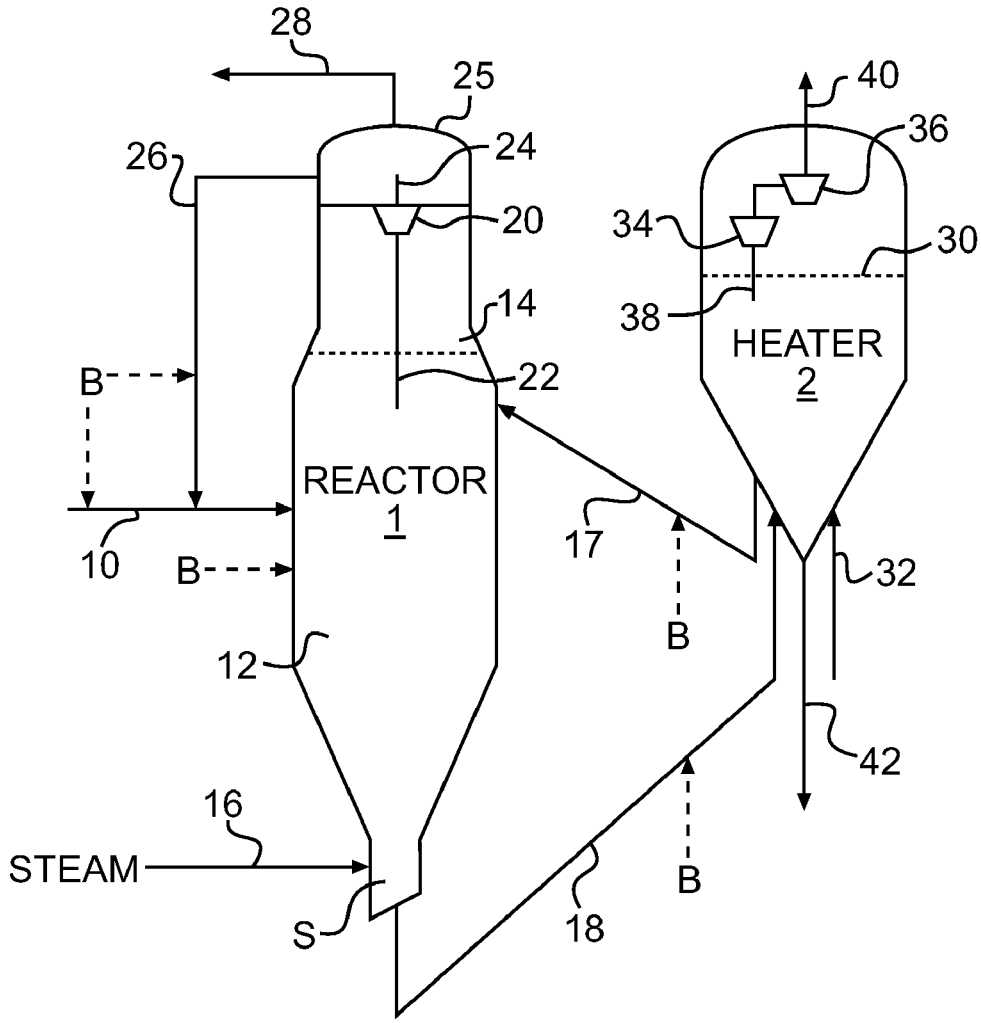
FIG. 1 hereof is a flow scheme of one preferred embodiment for practicing fluidized coking in a process unit that is comprised of a coking zone, a scrubbing zone, a stripping zone, and a heating zone.

Any heavy hydrocarbonaceous material typically used in a coking process can be used herein. Generally, the heavy hydrocarbonaceous material will have a Conradson carbon residue of about 5 to 40 wt. % and be comprised of moieties, the majority of which boil above about 975° F. (524° C.). Suitable hydrocarbonaceous materials include heavy petroleum crudes, petroleum atmospheric distillation bottoms, petroleum vacuum distillation bottoms, pitch, asphalt, bitumen, liquid products derived from coal liquefaction processes, including coal liquefaction bottoms, liquid products derived from oil shale processing and mixtures thereof.

A typical heavy hydrocarbonaceous feedstock suitable for the practice of the present invention will typically have a composition and properties within the ranges set forth below.

Conradson Carbon 5 to 40 wt. %
Sulfur 1.5 to 8 wt. %
Hydrogen 9 to 11.5 wt. %
Nitrogen 0.2 to 2 wt. %
Carbon 70 to 90 wt. %
Metals 1 to 2000 wppm
Boiling Point 340° C.+ to 650° C.+
Specific Gravity −10 to 35° API As previously mentioned, the rate of introduction of resid feedstock onto bed coke particles in a fluid coker reactor is limited by the rate at which it can be converted to coke. The major reactions that produce coke involve cracking of aliphatic side chains from aromatic cores, demethylation of aromatic cores, cyclic dehydrogenation reactions and aromatization. The rate of cracking of aliphatic side chains ($>C_7$), to produce liquids and gases including methane, is relatively fast and results in the buildup of a sticky layer of methylated aromatic cores on the bed coke particles. This layer is relatively sticky at reaction temperature. Sticky coke particles can agglomerate (become heavier) and be carried under into the stripper section and cause fouling, e.g., of the stripper sheds. De-methylation of aromatic cores produces methane and a less sticky coke. At the point of fluid bed bogging, the rate of sticky layer going to coke equals the rate of introduction of coke precursors from the resid feed. Practice of the instant invention results in an acceleration of the reactions involved in converting the sticky material to dry coke and thus allows increased reactor throughput at a given temperature or coking at a lower temperature at constant throughput. Less gas and higher quality liquids are produced at lower coking temperatures.

The process of the present invention will generally be conducted by introducing, into the coking zone with the hydrocarbonaceous feedstock, an effective amount of a basic material, which basic material is comprised of at least one basic alkali metal-containing compounds, or at least one alkaline earth-containing compounds, or a combination thereof. By effective amount we mean at least that amount that will result in a substantial increase in the rate of the formation of methane and dry coke material from the sticky material on the coke particles. This amount will typically be from about 100 to about 10,000 wppm, preferably from about 200 to about 5,000 wppm, and more preferably from about 250 to 3,000 wppm alkali and/or alkaline-earth metal containing compound. The preferred alkali metal compounds are Na and K basic compounds and mixtures thereof (e.g., $K_2CO_3$ and/or KOH) and the preferred alkaline-earth metal compounds are Ca and Mg basic compounds. Non-limiting examples of such compounds include the hydroxides, carbonates and acetates as well as alkyl and aryl carboxylates.

Reference is now made to FIG. 1 hereof which shows a simplified flow diagram of a typical fluidized coking process unit comprised of a coking reactor and a heater. A heavy hydrocarbonaceous chargestock is conducted via line 10 into coking zone 12 that contains a fluidized bed of solids having an upper level indicated at 14. Although it is preferred that the solids, or seed material, be coke particles, they may also be any other refractory materials such as those selected from the group consisting of silica, alumina, zirconia, magnesia, alundum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns. For purposes of this FIG. 1, the solid particles will be referred to coke, or coke particles.

A fluidizing gas e.g., steam, is introduced at the base of coker reactor 1, through line 16, in an amount sufficient to obtained superficial fluidizing velocity in the range of about 0.5 to 5 feet/second. Coke at a temperature above the coking temperature, for example, at a temperature from about 100° F. to about 400° F., preferably from about 1500 to about 350° F., and more preferably from about 1500 to 250° F., in excess of the actual operating temperature of the coking zone is admitted to reactor 1 by line 17 from heater 2 in an amount sufficient to maintain the coking temperature in the range of about 850° F. (454° C.) to about 1200° F. (650° C.). The pressure in the coking zone is maintained in the range of about 0 to 150 psig, preferably in the range of about 5 to 45 psig. The lower portion of the coking reactor serves as a stripping zone S in which occluded hydrocarbons are removed from the coke by use of a stripping agent, such as steam, as the coke particles move through the stripping zone. A stream of stripped coke is withdrawn from the stripping zone via line 18 and conducted to heater 2. Conversion products of the coking zone are passed through cyclone 20 where entrained solids are removed and returned to coking zone 12 via dipleg 22. The resulting vapors exit cyclone 20 via line 24, and pass into a scrubber 25 mounted at the top of the coking reactor 1. If desired, a stream of heavy materials condensed in the scrubber may be recycled to the coking reactor via line 26. Coker conversion products are removed from scrubber 25 via line 28 for fractionation in a conventional manner. In heater 2, stripped coke from coking reactor 1 (cold coke) is introduced via line 18 into a fluidized bed of hot coke having an upper level indicated at 30. The bed is heated by passing a fuel gas into the heater via line 32. The gaseous effluent of the heater, including entrained solids, passes through a cyclone which may be a first cyclone 34 and a second cyclone 36 wherein the separation of the larger entrained solids occur. The separated larger solids are returned to the heater via cyclone diplegs 38. The heated gaseous effluent that contains entrained solids is removed from heater 2 via line 40. Excess coke can be removed form heater 2 via line 42. A portion of hot coke is removed from the fluidized bed in heater 2 and recycled to coking reactor 1 via line 17 to supply heat to the coking zone.

The basic material can be introduced into the fluid coking process unit of the present invention at any one or more locations represented by B in the figure. For example, it can be introduced into one or both of lines 10 and 26. It can also be introduced independent of the feedstock directly into the coking zone 12, or into line 18 and carried to the heater then to the coking zone via line 17, or it can be introduced into recycle coke line 17. It is preferred that the basic material be introduced independent of the feedstock directly into the coking zone.

Having thus described the present invention, and a preferred and most preferred embodiment thereof, it is believed that the same will become even more apparent by reference to the following examples. It will be appreciated, however, that the examples are presented for illustrative purposes and should not be construed as limiting the invention.

The following examples are presented for illustrative purposes and are not to be taken a limiting in any way.

EXAMPLES

All of the following examples were performed using an open system pyrolysis unit coupled with a mass spectrometer to measure the rate of methane (mass 16) evolution from pyrolysis of the resid samples with and without the basic alkali or alkaline-earth-containing additive. The pyrolysis unit, referred to herein as the Temperature-Programmed Decomposition (TPD) unit is substantially the same as that described in Fuel, 1993, 72, 646. A fixed linear heating rate of 0.23° C. per second was employed in all experiments.

A 52 kcal/mol kinetic process to produce methane is associated primarily with the cracking of alkyl side chains (>Cl) of resid. Kinetic processes ≧54 kcal/mol are primarily associated with de-methylation reactions of aromatic cores. 23 TPD runs were conducted utilizing three different resids with and without the addition of 1000 wppm NaOH. The results of fits to the methane spectra employing a discrete distribution of activation energy at 2 kcal/mole increments and a fixed preexponential factor of $2\times10^{13}$ $sec^{-1}$, were pooled and analyzed using the analysis of variance (ANOVA) method coded in Statview statistical software. The results for the ≧54 kcal/mole methane evolution processes are shown in Table 1 below.

TABLE 1

| Activation Energy | Methane Mole Percent (≧54 kcal/mole) | |
|---|---|---|
| (kcal/mol) | Resid (no additive) | Resid (NaOH 1000 wppm) |
| 54 | 21.0 | 24.2 |
| 56 | 20.4 | 21.9 |
| 58 | 19.3 | 18.9 |
| 60 | 15.5 | 13.0 |
| 62 | 12.6 | 12.6 |

TABLE 1-continued

| Activation Energy | Methane Mole Percent (≧54 kcal/mole) | |
|---|---|---|
| (kcal/mol) | Resid (no additive) | Resid (NaOH 1000 wppm) |
| 64 | 7.8 | 6.7 |
| 66 plus | 3.4 | 2.7 |

Figure 2:
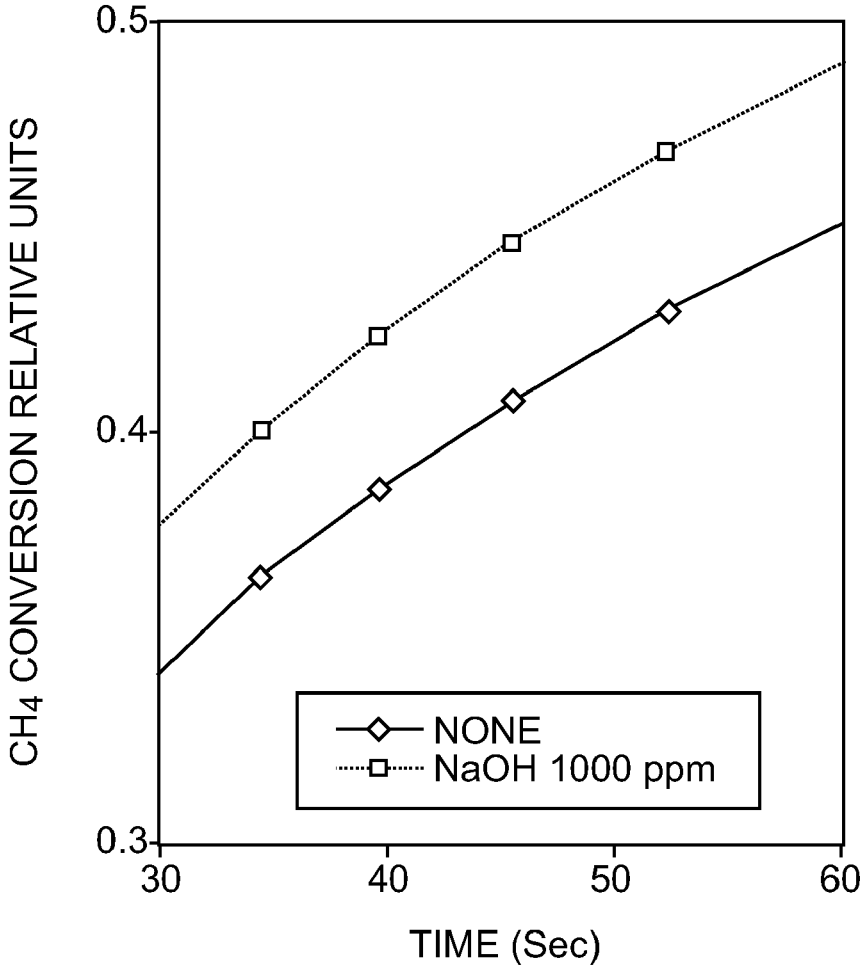
FIG. 2 hereof is a plot of the conversion to methane between 30 and 60 seconds for a resid with and without the addition 1,000 wppm sodium hydroxide run in a Temperature Programmed Decomposition unit as described in the examples hereof.
Figure 3:
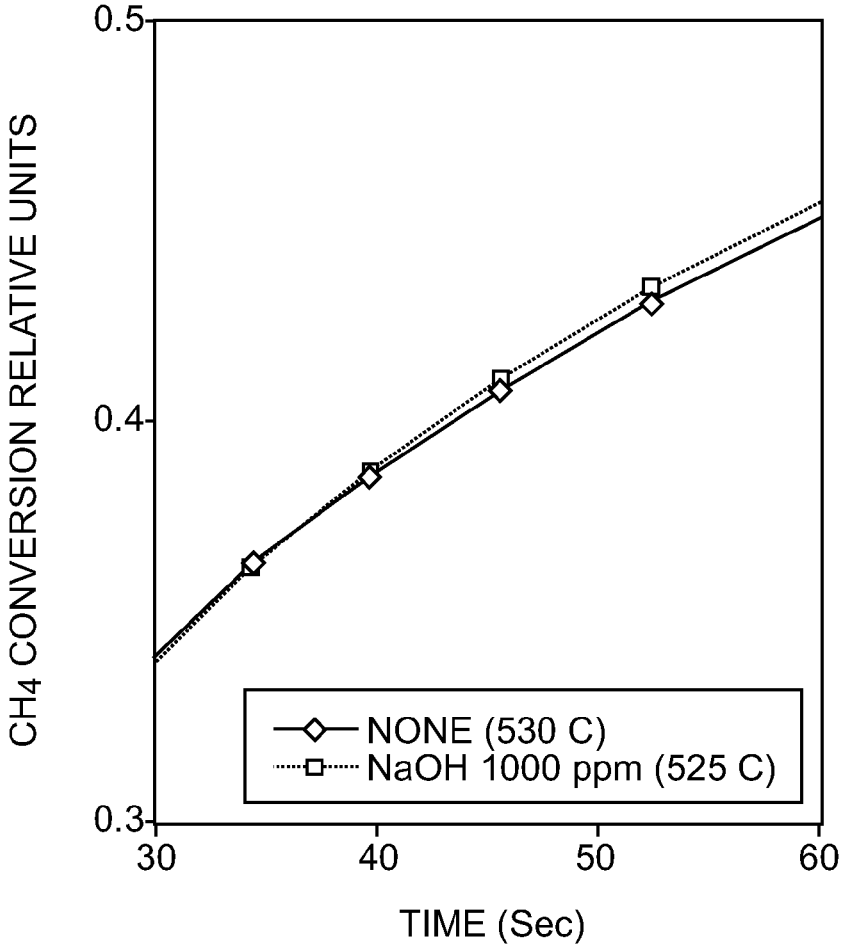
FIG. 3 hereof shows that fluid coking of a resid containing about 1000 wppm sodium hydroxide can be run at a lower temperature versus a resid without the addition of sodium hydroxide, under the same fluid coking conditions, with less cracking and more liquid make.

These kinetic results were used to predict the rate of methane evolution at a constant temperature of 530° C. (simulated fluid coking condition). FIG. 2 hereof is a plot of the conversions to methane between 30 and 60 seconds. Greater conversion at a constant time is predicted for resid to which 1000 wppm NaOH has been added over this time period. FIG. 2 hereof also evidences that the use of the alkali or alkaline-earth metal-containing compound of the present invention results in faster drying of sticky coke, thus Calculations were made at lower temperature for resid with 1000 wppm NaOH. FIG. 3 hereof shows that the same extent of conversion can be achieved at 5° C. lower reactor temperature when 1000 wppm NaOH is added to resid. This 5° C. lower reactor temperature is commercially significant because it results in substantially more liquid product being produced at the expense of undesirable gaseous product. Alternatively, if the unit is operating at an acceptable level, instead of lowering the temperature by 5° C., the feed rate may be increased proportionately to increase the capacity/throughput of the coker.

What is claimed is:

1. A process for converting a heavy hydrocarbonaceous feedstock to lower boiling products, which process is performed in a fluid coking process unit comprised of a fluid coking reactor and a fluidized bed heater but no gasifier, said fluid coking reactor containing a coking zone, a scrubbing zone located above said coking zone for collecting vapor phase products, and a stripping zone, located below the coking zone, for stripping hydrocarbons from solid coke particles passing downwardly through the stripping zone, a line for conducting the solid particles to the heater and a line for recycling hot coke directly from the heater to the coking zone, which process comprises:

[a] introducing the heavy hydrocarbonaceous feedstock having a Conradson carbon content of at least about 5 wt. % and an effective amount of a basic material to substantially increase the rate of formation of methane and dry coke into said coking zone containing a fluidized bed of solid particles and maintained at effective coking temperatures and pressures, wherein there is produced a vapor phase product, including normally liquid hydrocarbons, and where coke is deposited on said solid particles, wherein the basic material contains an alkali metal, an alkaline-earth metal or a combination thereof, wherein the effective amount of basic material used is from about 100 to about 10,000 wppm;

[b] passing said vapor phase product to said scrubbing zone;

[c] passing said solid particles from said coking zone, with coke deposited thereon, downwardly through said coking zone, past said stripping zone, thereby stripping hydrocarbons from the solid particles with a stripping agent, wherein the stripped solid particles exit said fluid coking reactor and are passed into said fluidized bed heating zone which contains a fluidized bed of solid coke particles and which is operated at a temperature greater than that of the coking zone; and

[d] recycling at least a portion of the solid coke particles from the heating zone to the coking zone through the line directly connecting the heater to the coking zone.

2. The process of claim 1 wherein heavy hydrocarbonaceous feedstock is selected from the group consisting of heavy and reduced petroleum crudes, petroleum atmospheric distillation bottoms, petroleum vacuum distillation bottoms, pitch, asphalt, bitumen, liquid products derived from a coal liquefaction process and liquid products derived from an oil shale conversion process.

3. The process of claim 1 wherein the basic material is selected from the group consisting of hydroxides, carbonates, acetates, cresylates and alkyl and aryl carboxylates.

4. The process of claim 3 wherein the basic material is an alkali metal compound and the alkali metal is selected from Na and K.

5. The process of claim 4 wherein the metal is Na.

6. The process of claim 5 wherein the compound is NaOH.

7. The process of claim 4 where the basic material is K.

8. The process of claim 4 where the basic material is KOH.

9. The process of claim 4 where the basic material is a mixture of Na and K salts.

10. The process of claim 1 wherein the basic material is injected with the feedstock into the coking zone.

* * * * *